US010351925B2

(12) United States Patent
Katagiri et al.

(10) Patent No.: US 10,351,925 B2
(45) Date of Patent: Jul. 16, 2019

(54) STEEL PLATE HAVING EXCELLENT ACID DEW POINT CORROSION RESISTANCE, METHOD OF PRODUCTION, AND EXHAUST GAS CHANNEL CONSTITUENT MEMBER

(71) Applicant: NIPPON STEEL NISSHIN CO., LTD., Tokyo (JP)

(72) Inventors: Yukio Katagiri, Hiroshima (JP); Akito Kawamoto, Hiroshima (JP); Susumu Fujiwara, Hiroshima (JP)

(73) Assignee: NIPPON STEEL NISSHIN CO., LTD., Tokyo (JP)

( * ) Notice: Subject to any disclaimer, the term of this patent is extended or adjusted under 35 U.S.C. 154(b) by 123 days.

(21) Appl. No.: 15/127,820

(22) PCT Filed: Mar. 26, 2015

(86) PCT No.: PCT/JP2015/059375
§ 371 (c)(1),
(2) Date: Sep. 21, 2016

(87) PCT Pub. No.: WO2015/147166
PCT Pub. Date: Oct. 1, 2015

(65) Prior Publication Data

US 2017/0114425 A1 Apr. 27, 2017

(30) Foreign Application Priority Data

Mar. 28, 2014 (JP) ..... 2014-069095

(51) Int. Cl.
*C22C 38/02* (2006.01)
*C22C 38/04* (2006.01)
(Continued)

(52) U.S. Cl.
CPC ..... *C21D 9/46* (2013.01); *B22D 11/001* (2013.01); *C21D 8/021* (2013.01); *C21D 8/0226* (2013.01);
(Continued)

(58) Field of Classification Search
None
See application file for complete search history.

(56) References Cited

U.S. PATENT DOCUMENTS 3,459,538 A 8/1969 Teramae et al.
2005/0013722 A1* 1/2005 Usami ..... B23K 35/3053 420/93

FOREIGN PATENT DOCUMENTS

JP 2003-213367 7/2003
JP 2012-057221 3/2012
JP 2012-180546 9/2012

* cited by examiner

*Primary Examiner* — Deborah Yee
(74) *Attorney, Agent, or Firm* — Clark & Brody

(57) ABSTRACT

A steel plate excellent in acid dew point corrosion resistance has a composition, in mass percent, from 0.001 to 0.15% of C, 0.80% or less of Si, 1.50% or less of Mn, 0.025% or less of P, 0.030% or less of S, from 0.10 to 1.00% of Cu, 0.50% or less of Ni, from 0.05 to 0.25% of Cr, 0.01 to 0.08% of Mo, 0.100% or less of Al, from 0 to 0.20% in total of Ti, Nb, and V, from 0 to 0.010% of B, from 0 to 0.10% in total of Sb and Sn, and a balance of Fe and unavoidable impurities, having a ferrite single phase structure, or a structure containing 30% by volume or less in total of one or more of cementite, pearlite, bainite, and martensite, with the balance ferrite phase. Ferrite crystal grains have an average crystal grain diameter of 12.0 mm or less.

8 Claims, 2 Drawing Sheets

(51) Int. Cl.

| | |
|---|---|
| ***C22C 38/16*** | (2006.01) |
| ***C22C 38/20*** | (2006.01) |
| ***C22C 38/22*** | (2006.01) |
| ***C22C 38/42*** | (2006.01) |
| ***C22C 38/44*** | (2006.01) |
| ***C22C 38/12*** | (2006.01) |
| ***C21D 9/46*** | (2006.01) |
| ***C21D 8/02*** | (2006.01) |
| ***C22C 38/00*** | (2006.01) |
| ***C22C 38/60*** | (2006.01) |
| ***C22C 38/06*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***B22D 11/00*** | (2006.01) |

(52) U.S. Cl.

CPC ..... *C21D 8/0236* (2013.01); *C21D 8/0263* (2013.01); *C21D 8/0273* (2013.01); *C22C 38/00* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/60* (2013.01); *C21D 2211/002* (2013.01); *C21D 2211/003* (2013.01); *C21D 2211/005* (2013.01); *C21D 2211/008* (2013.01); *C21D 2211/009* (2013.01)

STEEL PLATE HAVING EXCELLENT ACID DEW POINT CORROSION RESISTANCE, METHOD OF PRODUCTION, AND EXHAUST GAS CHANNEL CONSTITUENT MEMBER

TECHNICAL FIELD

On a surface of a member in contact with a gas containing a sulfur oxide or hydrogen chloride, so-called "sulfuric acid condensation" or "hydrochloric acid condensation" occurs in a low temperature condition lower than the dew point of the gas. In the case where the member is a metal, there are cases where corrosion proceeds with condensed water containing sulfuric acid or hydrochloric acid to cause a problem. The corrosion due to an acid in condensed water is referred to as "acid dew point corrosion" in the description herein. The present invention relates to a steel imparted with resistance to acid dew point corrosion, and an exhaust gas channel constituent member using the same.

BACKGROUND ART

A combustion exhaust gas from a thermal electric power plant and a waste combustion plant is constituted mainly by water, a sulfur oxide (such as sulfur dioxide and sulfur trioxide), hydrogen chloride, a nitrogen oxide, carbon dioxide, nitrogen, oxygen and the like. When sulfur trioxide is contained in the exhaust gas at least in 1 ppm, the dew point of the exhaust gas often reaches 100° C. or more, and sulfuric acid condensation is liable to occur. An exhaust gas from a coal-fired thermal electric power plant and an exhaust gas from a waste combustion plant (an incineration facility for municipal waste or an incineration facility for industrial waste) contain a considerable amount of hydrogen chloride, and hydrochloric acid condensation is also liable to occur.

The temperature where sulfuric acid condensation occurs (i.e., the sulfuric acid dew point) and the temperature where the hydrochloric acid condensation occurs (i.e., the hydrochloric acid dew point) may vary depending on the combustion exhaust gas composition. In general, the sulfuric acid dew point is often approximately from 100 to 150° C., whereas the hydrochloric acid dew point is often approximately from 50 to 80° C. and thus a portion subjected to sulfuric acid dew point corrosion and a portion subjected to hydrochloric acid dew point corrosion may be formed even in the exhaust gas channel in one combustion plant. Accordingly, a material that is excellent in both sulfuric acid dew point corrosion resistance and hydrochloric acid dew point corrosion resistance is necessarily applied to a metal member at a relatively low temperature in an exhaust gas channel (such as a member constituting a duct wall and a chimney of a flue, a member of a dust collector, and a member of a heat exchanger for utilizing the heat of the exhaust gas).

A Sb-bearing steel has been known as a steel that is improved in acid dew point corrosion resistance (see PTLs 1 and 2). In particular, for improving both the sulfuric acid dew point corrosion resistance and the hydrochloric acid dew point corrosion resistance, it is said that the combined addition of Sb and Cu, and furthermore Mo is effective (see PTL 2).

However, since Sb is an expensive element, it may be a factor of cost increase of a steel material, and there is a fear in the raw material procurement in the case where a large amount of Sb is consumed as a raw material of a steel material. Furthermore, the addition of Sb may deteriorate the hot workability of the steel.

A stainless steel is also known as a material excellent in acid resistance, but there are cases where corrosion is more liable to proceed than the Sb-bearing steel depending on the concentration and the temperature of the acid. A stainless steel is expensive and is not a material that is completely satisfactory against the acid dew point corrosion.

According to the investigation made by the present inventors, et al., the characteristics of both sulfuric acid corrosion resistance and hydrochloric acid corrosion resistance can be improved by strictly controlling the amount of Cr and Mo added without the addition of Sb (see PTL 3).

CITATION LIST

Patent Literatures

PTL 1: JP-B-43-14585
PTL 2: JP-A-2003-213367
PTL 3: JP-A-2012-57221

SUMMARY OF INVENTION

Technical Problem

According to the technique of PTL 3, a steel having acid dew point corrosion resistance that is equivalent to the Sb-bearing steel may be achieved. However, the ranges of the contents of Cu, Cr, and Mo providing such excellent acid dew point corrosion resistance are narrow, which may lead increase of the production cost associated with deterioration in yield and deterioration in productivity in the production thereof. Furthermore, there is a demand of further enhancement of the level of the acid dew point corrosion resistance in recent years.

The invention is to enhance the level of the acid dew point corrosion resistance and to provide a technique of stably achieving excellent acid dew point corrosion resistance equivalent to the steel plate described in PTL 3 in a wider compositional range.

Solution to Problem

As a result of detailed investigations made by the inventors, it has been found that in a steel that is improved in both sulfuric acid dew point corrosion resistance and hydrochloric acid dew point corrosion resistance simultaneously by adding Cu, Cr, and Mo in combination and regulating the contents of the elements to the particular ranges, the acid dew point corrosion resistance can be further enhanced by controlling to reduce the crystal grain diameter of the ferrite phase. Furthermore, it has been also found that the allowable ranges of the contents of Cu, Cr, and Mo that provide good acid dew point corrosion resistance are broadened. The method of enhancing the acid dew point corrosion resistance by utilizing the reduction in diameter of the crystal grains in combination is extremely effective for improving the acid dew point corrosion resistance of a steel formed of ordinary steel component elements but not containing a special element, such as Sb. Furthermore, the application of the method to a Sb-bearing steel can further significantly enhance the resistance particularly to sulfuric acid corrosion. The invention has been completed based on the novel finding.

The objects may be achieved by a steel plate excellent in acid dew point corrosion resistance, having a chemical composition of, in terms percentage by mass, from 0.001 to 0.15% of C, 0.80% or less of Si, 1.50% or less of Mn, 0.025% or less of P, 0.030% or less of S, from 0.10 to 1.00% of Cu, 0.50% or less of Ni, from 0.05 to 0.25% of Cr, 0.01 to 0.08% of Mo, 0.100% or less of Al, from 0 to 0.20% in total of Ti, Nb, and V, from 0 to 0.010% of B, and from 0 to 0.10% in total of Sb and Sn, with the balance of Fe and unavoidable impurities, having a ferrite single phase structure, or a structure containing 30% by volume or less in total of one or more of cementite, pearlite, bainite, and martensite, with the balance of a ferrite phase, and ferrite crystal grains having an average crystal grain diameter of 12.0 μm or less. It is advantageous that the S content is more than 0.005% particularly for a purpose, in which the sulfuric acid dew point corrosion resistance is important.

In the chemical composition, Ti, Nb, V, B, Sb, and Sn are elements that are arbitrarily contained. In the case where Ti, Nb, and V are contained, it is more effective that the total content of one kind or two or more kinds thereof is from 0.005 to 0.20%. In the case where B is contained, it is more effective that the content thereof is from 0.0005 to 0.010%. In the case where Sb and Sn are contained, it is more effective that the content of one kind or two kinds thereof is from 0.005 to 0.10%.

The average crystal grain diameter of the ferrite crystal grains may be determined by the following item (X) according to the intercept method of JIS G0551:2013.

(X) The metal structure on the cross section in parallel to the rolling direction and the thickness direction (L cross section) of the steel plate was observed with a microscope, the grain size number G is obtained by the "evaluation method of a ferrite crystal grains by the intercept method" in Annex JB of JIS G0551:2013 and is substituted into the following expression (1) to provide the average number of crystal grains m per 1 $mm^2$ of the cross section of the specimen, and then the value m is substituted into the following expression (2) to determine the average crystal grain diameter $D_M$ (μm) of the ferrite crystal grains.

$$m=8\times2^{G} \quad (1)$$

$$D_M=m^{(-1/2)}\times10^3 \quad (2)$$

Herein, the expression (1) corresponds to the expression (1) defined in the paragraph 7.1 of JIS G0551:2013, and the expression (2) corresponds to the average crystal grain diameter obtained by converting the average crystal grain diameter (mm) defined in the table 1 of JIS G0551:2013 to the unit of μm.

Embodiments of the steel plate excellent in acid dew point corrosion resistance include a hot-rolled steel plate, a cold-rolled steel plate, and a cold-rolled and annealed steel plate. A steel plate that is obtained by subjecting a cold-rolled and annealed steel plate to skin pass rolling (for example, with an elongation of 3% or less) is also encompassed by the cold-rolled and annealed steel plate referred herein.

As a method for producing the "hot-rolled steel plate", there is provided a method for producing a hot-rolled steel plate having a ferrite single phase structure, or a structure containing 30% by volume or less in total of one or more of cementite, pearlite, bainite, and martensite, with the balance of a ferrite phase, and ferrite crystal grains having an average crystal grain diameter of 12.0 μm or less, the method containing subjecting a continuously cast slab having the aforementioned chemical composition, to hot rolling under a condition of a finish rolling temperature of 900° C. or less and a coiling temperature of 650° C. or less. In the case where one or more of Ti, Nb, and V is contained in an amount of from 0.005 to 0.20%, and the case where B is contained in an amount of from 0.0005 to 0.010%, the finish rolling temperature may be in a range of 930° C. or less. The hot-rolled steel plate may be further subjected to cold rolling, thereby providing the "cold-rolled steel plate" excellent in acid dew point corrosion resistance.

The finish rolling temperature herein means the temperature of the surface of the plate material that is subjected to the final rolling pass of the hot rolling.

As a method for producing the "cold-rolled and annealed steel plate", there is provided a method for producing a cold-rolled steel plate having a ferrite single phase structure, or a structure containing 30% by volume or less in total of one or more of cementite, pearlite, bainite, and martensite, with the balance of a ferrite phase, and ferrite crystal grains having an average crystal grain diameter of 12.0 μm or less, containing a hot rolling step, a cold rolling step, and an annealing step, the hot rolling step being performed at a finish rolling temperature of 900° C. or less and a coiling temperature of 650° C. or less, and the annealing step being performed at a heating temperature of from 600 to 830° C. In the case where one or more of Ti, Nb, and V is contained in an amount of from 0.005 to 0.20%, and the case where B is contained in an amount of from 0.0005 to 0.010%, the finish rolling temperature may be in a range of 930° C. or less. The hot-rolled and annealed steel plate may be further subjected to cold rolling, thereby providing the "cold-rolled steel plate" excellent in acid dew point corrosion resistance.

The invention also provides an exhaust gas channel constituent member containing a steel plate formed of a steel having the aforementioned chemical composition and metal structure, the member constituting an exhaust gas channel of a combustion exhaust gas from a coal-fired thermal electric power plant or an exhaust gas from a waste combustion plant, in a portion where condensation occurs on a surface thereof through exposure to the exhaust gas.

The exhaust gas channel constituent member herein includes a member constituting the structure of the exhaust gas channel (such as a duct channel (such as members of a dust collector and a heat exchanger). Examples of the member of the heat exchanger include a cooling fin attached to a pipe, through which a fluid receiving heat flows.

Advantageous Effects of Invention

According to the invention, a steel plate that is significantly improved in sulfuric acid dew point corrosion resistance and hydrochloric acid dew point corrosion resistance simultaneously can be achieved by using a steel formed of ordinary steel component elements that do not include a special element, such as Sb and Sn. The improvement effect exceeds the acid dew point corrosion resistant steel plate described in PTL 3. Furthermore, the allowable ranges of the contents of Cu, Cr, and Mo can be broadened as compared to the technique of PTL 3, and the acid dew point corrosion resistant steel plate can be easily produced. Moreover, the application of the technique of the invention to a steel containing Sb and Sn can impart further excellent acid corrosion resistance thereto. Accordingly, the invention is extremely useful for constituting an exhaust gas channel particularly in a coal-fired thermal electric power plant or an exhaust gas from a waste combustion plant.

DESCRIPTION OF EMBODIMENTS

The steel plate applied to the invention has such features as the chemical composition of a Cu-bearing steel containing Cr and Mo added in particular amounts in combination and the metal structure controlled to reduce the ferrite crystal grain diameter. The inventors consider as follows with respect to the mechanism of the significant improvement of both the sulfuric acid dew point corrosion resistance and the hydrochloric acid dew point corrosion resistance.

(1) Cu is effective for forming an insoluble CuS film, and the film enhances particularly the resistance to sulfuric acid.

(2) A steel that has contents of Cr and Mo outside the scope of the invention forms a corrosion product in a scale form, whereas a steel that has Cr and Mo added in the proper ranges forms corrosion product in a densified bulky form, and the densification of the corrosion product enhances particularly the sulfuric acid corrosion resistance.

(3) In an electrochemical measurement, the anode-cathode reaction slows down in the proper addition amount ranges of Cr and Mo in both a sulfuric acid environment and a hydrochloric acid environment, and thus the dissolution characteristics directly contribute to the suppression of dissolution of the steel base material (Fe) in a sulfuric acid environment and a hydrochloric acid environment.

(4) The reduction of the ferrite crystal grain diameter finely disperses the crystal grain boundaries, which may be starting points of corrosion with an acid, so as to slow down the progression rate of corrosion.

Sulfuric Acid Dew Point Corrosion Resistance

Figure 1:
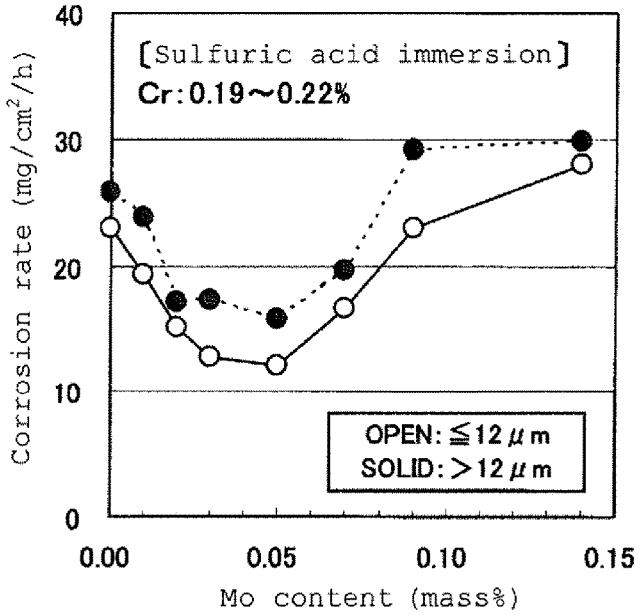
FIG. 1 is a graph exemplifying the influence of the Mo content on the corrosion rate in a sulfuric acid aqueous solution.
Figure 2:
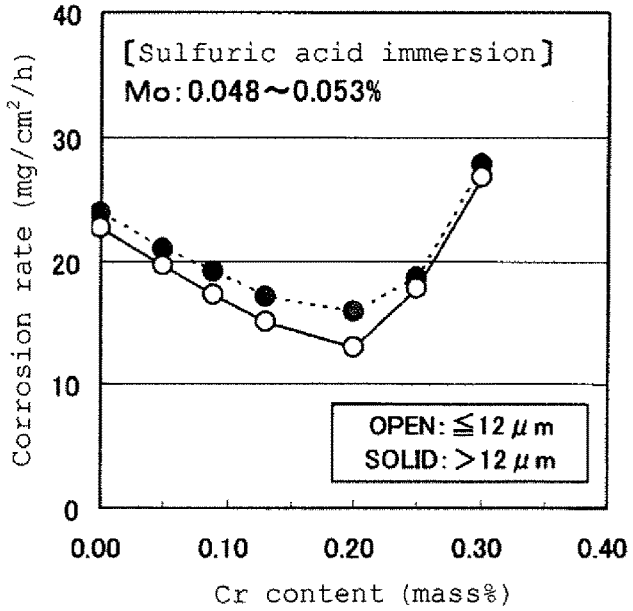
FIG. 2 is a graph exemplifying the influence of the Cr content on the corrosion rate in a sulfuric acid aqueous solution.

FIGS. 1 and 2 each exemplify the influence of the Mo content and the Cr content on the corrosion rate in a sulfuric acid aqueous solution. As an extremely severe condition assuming a combustion gas of heavy oil (coal), the sulfuric acid aqueous solution has a sulfuric acid concentration of 40% by mass and a temperature of 60° C. and the immersion time is 6 hours. The steel plates used are cold-rolled and annealed steel plates, and the steel plates in FIG. 1 have a substantially constant Cr content in a 0.2% by mass level, whereas the steel plates in FIG. 2 have a substantially constant Mo content in a 0.05% by mass level. All the steel plates contain no Sb and Sn added, and the contents of the balance elements except for Cr and Mo are in the ranges specified in the invention. In the figures, the plots shown by black dots (SOLID) are ones having an average crystal grain diameter of the ferrite crystal grains (which is hereinafter referred to as a "ferrite average crystal grain diameter") exceeding 12.0 μm, and correspond to the ones described in FIGS. 1 and 2 of PTL 3. The plots shown by the white dots (OPEN) are ones having a ferrite average crystal grain diameter of 12.0 μm or less.

In this immersion test, the corrosion rate of the conventional acid dew point corrosion resistant steel containing Sb, Cu, and Mo is substantially in a range of from 10 to 20 mg/cm$^2$/h. As shown in FIGS. 1 and 2, in the compositional range of a Mo content around 0.05% by mass and a Cr content around 0.20% by mass, excellent sulfuric acid dew point corrosion resistance equivalent to the conventional Sb-bearing steel can be obtained. Furthermore, it is understood that the level of the sulfuric acid dew point corrosion resistance is further stably enhanced by controlling the ferrite average crystal grain diameter to 12.0 μm or less. Associated with the enhancement of the level of the sulfuric acid dew point corrosion resistance, the proper ranges of the Mo amount and the Cr amount for achieving a certain corrosion rate (for example, 20 mg/cm$^2$/h or less) are broadened.

Hydrochloric Acid Dew Point Corrosion Resistance

Figure 3:
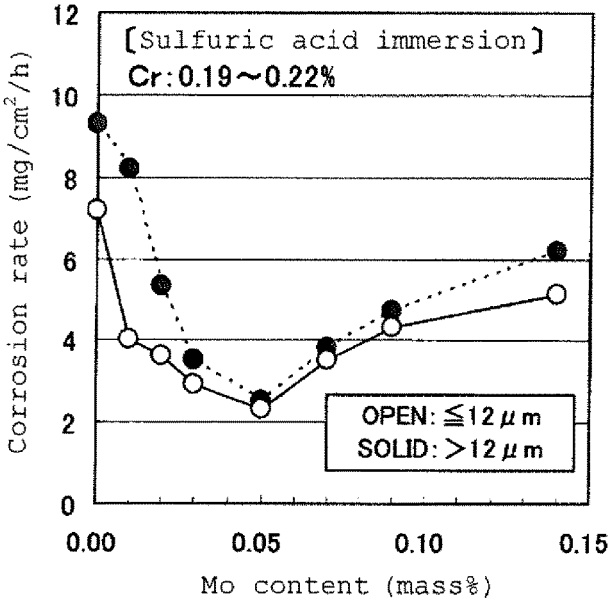
FIG. 3 is a graph exemplifying the influence of the Mo content on the corrosion rate in a hydrochloric acid aqueous solution.
Figure 4:
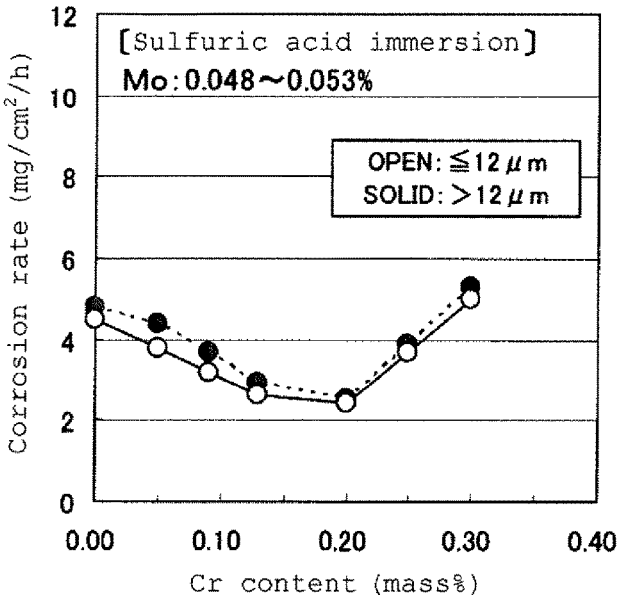
FIG. 4 is a graph exemplifying the influence of the Cr content on the corrosion rate in a hydrochloric acid aqueous solution.

FIGS. 3 and 4 each exemplify the influence of the Mo content and the Cr content on the corrosion rate in a hydrochloric acid aqueous solution. As an extremely severe condition assuming a waste combustion plant, the hydrochloric acid aqueous solution has a hydrochloric acid concentration of 1% by mass and a temperature of 80° C. and the immersion time is 6 hours. The steel plates used are the same as those used in FIGS. 1 and 2, respectively. In the figures, the plots shown by black dots (SOLID) are ones having a ferrite average crystal grain diameter exceeding 12.0 μm, and correspond to the ones described in FIGS. 3 and 4 of PTL 3. The plots shown by the white dots (OPEN) are ones having a ferrite average crystal grain diameter of 12.0 μm or less.

In this immersion test, the corrosion rate of the conventional acid dew point corrosion resistant steel containing Sb, Cu, and Mo is substantially in a range of from 2 to 4 mg/cm$^2$/h. As shown in FIGS. 3 and 4, in the compositional range of a Mo content around 0.05% by mass and a Cr content around 0.20% by mass, excellent hydrochloric acid dew point corrosion resistance can be obtained. Furthermore, it is understood that the level of the hydrochloric acid dew point corrosion resistance is further stably enhanced by controlling the ferrite average crystal grain diameter to 12.0 μm or less. Associated with the enhancement of the level of the hydrochloric acid dew point corrosion resistance, the proper ranges of the No amount and the Cr amount for achieving a certain corrosion rate (for example, 4 mg/cm$^2$/h or less) are broadened.

Chemical Composition

The compositional elements of the steel of the invention will be described. The "%" for the compositional elements means percentage by mass.

C does not largely influence the acid dew point corrosion resistance and thus may not be necessarily limited, but the content thereof is from 0.001 to 0.15% from the standpoint of ensuring the strength as a general structural material.

Si is necessary for deoxidizing in steel making, and is an element effective for ensuring the strength as a general structural material. A Si content of 0.05% or more is effectively ensured. However, excessive addition of Si may lower the descaling property at the time of hot rolling to cause increase of scale defects, and may be a factor of reduction of the weldability. As a result of various investigations, the Si content is limited to 0.80% or less.

Mn is effective for controlling the strength of the steel, and has a function of preventing hot brittleness due to S. The Mn content is more effectively 0.10% or more, and the Mn content may be managed to be 0.30% or more, or 0.50% or more. However, Mn may be a factor of reduction of the hydrochloric acid corrosion resistance. As a result of various investigations, the Mn content is allowed to be 1.50% at most, and may be managed to be in a range of 1.20% or less, or 1.00% or less.

P is limited to 0.025% or less since it deteriorates the hot workability and the weldability. For further enhancing the sulfuric acid corrosion resistance and the hydrochloric corrosion resistance, it is effective to reduce the P content, but the excessive reduction thereof may increase the steel making cost, which may be a factor of increasing the cost. As a result of various investigations, the P content may be controlled to a range of from 0.005 to 0.025%, and is more preferably from 0.005 to 0.015%.

S is limited to 0.030% or less since it deteriorates the hot workability and the corrosion resistance, and is more preferably 0.018% or less. As for the sulfuric acid dew point corrosion resistance, however, a certain amount of S contained functions advantageously. As a result of various investigations, in the case where the sulfuric acid dew point corrosion resistance is particularly important, the S content is effectively 0.003% or more, and more effectively 0.005% or more.

Cu is effective for enhancing the sulfuric acid corrosion resistance and the hydrochloric acid corrosion resistance, and in the invention, it is necessary to ensure a Cu content of 0.10% or more. However, the excessive addition of Cu may be a factor of deteriorating the hot workability, and thus the content thereof is desirably 1.00% or less.

While Ni does not act directly on the enhancement of the sulfuric acid corrosion resistance and the hydrochloric acid corrosion resistance, Ni is an element that exhibits a function of suppressing the deterioration of the hot workability due to the addition of Cu, and the content thereof is desirably 0.01% or more. In the case where the hot workability is important, the Ni content is effectively 0.05% or more, and more effectively 0.10% or more. However, the effect of the addition thereof may be saturated when the content thereof exceeds 0.50% to increase the cost, and thus the Ni content may be in a range of 0.50% or less.

Cr and Mo are important elements for enhancing the sulfuric acid dew point corrosion resistance and the hydrochloric acid dew point corrosion resistance simultaneously without the function of the special element, such as Sb. In the invention, which intends to enhance the acid dew point corrosion resistance by reducing the size of the ferrite crystal grains, the allowable ranges of the contents of Cr and Mo can be broadened as compared to the technique described in PTL 3. As a result of various investigations, the sulfuric acid dew point corrosion resistance and the hydrochloric acid dew point corrosion resistance can be simultaneously improved by adding Cr in an amount of from 0.05 to 0.25% and Mo in an amount of from 0.01 to 0.08% in combination. The Cr content is more effectively from 0.10 to 0.25%. The Mo content is more effectively from 0.03 to 0.07%.

Al is necessary for deoxidizing in steel making. The Al content is effectively controlled to 0.005% or more, and more effectively to 0.010% or more. However, Al may be a factor of deteriorating the hot workability. As a result of various investigations, the Al content is limited to 0.100% or less, and may be managed to 0.050% or less.

Ti, Nb, and V have a function of reducing the ferrite crystal grain diameter and are effective for improving the acid dew point corrosion resistance. Accordingly, one or more of them may be added depending on necessity. In this case, it is more effective that the total content of one or more of Ti, Nb, and V is effectively 0.005% or more. However, the excessive addition thereof may make the function saturated to increase the production cost. In the case where one or more of Ti, Nb, and V is added, the total content thereof is desirably 0.20% or less.

B is an element that is capable of exhibiting a function of reducing the ferrite crystal grain diameter with a small amount of addition thereof, and may be added depending on necessity. It is more effective that the content of B is 0.0005% or more. However, the excessive addition of B may make the function saturated to increase the production cost. In the case where B is added, the addition is desirably performed to make the content thereof in a range of 0.010% or less.

Sb and Sn are elements that are effective for improving the acid dew point corrosion resistance through the function of slowing down the electrochemical anode-cathode reaction, as similar to Cr and Mo. In the invention, as described above, the significant improvement of the acid dew point corrosion resistance can be obtained through the proper contents of Cr and Mo and the reduction of the ferrite crystal grain diameter without the addition of Sb and Sn, but in the case where Sb and Sn are added, the acid dew point corrosion resistance can further be enhanced. In particular, it has been found that the addition of Sb is extremely effective for increasing the resistance to sulfuric acid dew point corrosion. Accordingly, in the case where the further improvement of the acid dew point corrosion resistance is important, one or more of Sb and Sn may be added depending on necessity. For sufficiently exhibiting the effect of the addition of these elements, one or more Sb and Sn are desirably added to make a total content thereof of 0.005% or more. However, the excessive addition thereof may make the function saturated to increase the production cost. In the case where one or more of Sb and Sn is added, the total content thereof is desirably 0.10% or less.

Metal Structure

The steel plate applied to the invention has a ferrite single phase structure, or a structure containing 30% by volume or less in total of one or more of cementite, pearlite, bainite, and martensite, with the balance of a ferrite phase. In the description herein, cementite, pearlite, bainite, and martensite may be referred to as the second phase in some cases. Among these, the pearlite is a lamellar structure constituted by a thin ferrite phase and a thin cementite phase, and the ferrite phase constituting the pearlite is not included in the ferrite phase that is described as the balance of the second phase in the description herein, that is, the measurement target of the ferrite average crystal grain diameter. Similarly, the cementite constituting the pearlite is not included in the cementite that is described as the constitutional element of the second phase in parallel to the pearlite.

The presence of the second phase is effective for enhancing the strength of the steel. On the contrary, the presence thereof is disadvantageous for the ductility. The proportion of the second phase present may be controlled depending on the purpose. A ferrite single phase structure containing no second phase may be used. In consideration of the workability that is generally necessary in an exhaust gas channel constituent member, the amount of the second phase present is desirably 30% by volume or less, and more preferably 10% by volume or less.

In the invention, it is extremely important that the ferrite crystal grains in the steel plate are fine. The inventors have found that in a steel having a Cr content and a Mo content controlled to the certain ranges, the acid dew point corrosion resistance thereof can be stably enhanced by reducing the crystal grain diameter of the ferrite crystal grains (see FIGS. 1 to 4). As a mechanism therefor, it is considered that the crystal grain boundaries, which may be starting points of corrosion with an acid, are finely dispersed, so as to slow down the progression rate of corrosion. As a result of various investigations, in a steel having the proper chemical composition as above, a stable improvement effect of the acid dew point corrosion resistance can be obtained in the case where the ferrite average crystal grain diameter is 12.0 μm or less. The ferrite average crystal grain diameter applied herein is obtained by the method described in the item (X) above.

Production Method

For stably providing a steel plate having a ferrite average crystal grain diameter controlled to 12.0 μm or less, it is preferred that in the hot rolling step, the finish rolling temperature is 900° C. or less, and the coiling temperature is 650° C. or less. It is more preferred that the finish rolling temperature is 870° C. or less, and the coiling temperature is 600° C. or less. In the case where one or more of Ti, Nb, and V which have a function of reducing the crystal grain diameter is contained in an amount of from 0.005 to 0.20%, and the case where B is contained in an amount of from 0.0005 to 0.010%, the finish rolling temperature may be in a range of 930° C. or less.

With a steel that satisfies the aforementioned chemical composition, a hot-rolled steel plate having a ferrite single phase structure, or a structure containing 30% by volume or less in total of one or more of cementite, pearlite, bainite, and martensite, with the balance of a ferrite phase can be obtained under the hot rolling condition. The resulting hot-rolled steel plate may be applied directly to an exhaust gas channel constituent member of a coal-fired thermal electric power plant, and can be used after removing oxidized scales by acid cleaning depending on the purpose, such as a fin material of a heat exchanger.

A "cold-rolled steel plate" that is obtained by subjecting the hot-rolled steel plate obtained by the aforementioned hot rolling to cold rolling also has excellent acid dew point corrosion resistance. A cold-rolled product may be applied as a high-strength steel plate to various purposes. Acid cleaning is generally performed before the cold rolling.

In the case where a steel plate is used by subjecting to bending work or the like, it is advantageous from the standpoint of workability that a "cold-rolled and annealed steel plate" is produced by subjecting the cold-rolled steel plate to annealing. In this case, for stably providing a steel plate having a ferrite average crystal grain diameter controlled to 12.0 μm or less, it is preferred that the heating temperature in the annealing step (i.e., the maximum achieving temperature of the material) is from 600 to 830° C. Furthermore, the heating profile in the annealing step may be controlled to control the volume proportion of the second phase and the kind of the second phase formed. In the production of the cold-rolled and annealed steel plate, skin pass rolling (for example, with an elongation of 3% or less) may be performed depending on necessity after annealing.

In the case where the thickness is further reduced, a "cold-rolled steel plate" that is obtained by further subjecting the cold-rolled and annealed steel plate to cold rolling may also be used. The cold-rolled steel plate also has excellent acid dew point corrosion resistance. The cold rolling step and the annealing step may be performed plural times to provide a "cold-rolled and annealed steel plate". In this case, in all the annealing steps, the heating temperature is preferably from 600 to 830° C.

EXAMPLES

Example 1

The steel species shown in Table 1 were prepared through melting, and subjected to hot rolling under a condition of an extraction temperature of 1,250° C. a finishing temperature of one of two levels, i.e., 920° C. and 860° C. and a coiling temperature of 550° C. so as to provide hot-rolled steel plates having a thickness of 2.0 mm. The resulting hot-rolled steel plates were subjected to acid cleaning for removing scales, and used as specimens.

TABLE 1

| Steel | Chemical composition (% by mass) | | | | | | | | | | | |
|---|---|---|---|---|---|---|---|---|---|---|---|---|
| No. | C | Si | Mn | P | S | Cu | Ni | Cr | Mo | Al | Balance | Class |
| 1 | 0.040 | 0.28 | 0.87 | 0.011 | 0.012 | 0.28 | 0.15 | 0.20 | 0.005 | 0.018 | — | comparative steel |
| 2 | 0.045 | 0.26 | 0.79 | 0.013 | 0.007 | 0.32 | 0.20 | 0.22 | 0.010 | 0.033 | — | steel of invention |
| 3 | 0.043 | 0.31 | 0.88 | 0.009 | 0.009 | 0.31 | 0.15 | 0.21 | 0.018 | 0.025 | — | steel of invention |
| 4 | 0.049 | 0.32 | 0.92 | 0.012 | 0.014 | 0.29 | 0.14 | 0.21 | 0.030 | 0.024 | — | steel of invention |
| 5 | 0.043 | 0.28 | 0.87 | 0.008 | 0.014 | 0.29 | 0.14 | 0.20 | 0.048 | 0.024 | — | steel of invention |
| 6 | 0.046 | 0.33 | 0.87 | 0.009 | 0.014 | 0.31 | 0.16 | 0.19 | 0.070 | 0.034 | — | steel of invention |
| 7 | 0.034 | 0.29 | 0.81 | 0.012 | 0.009 | 0.29 | 0.15 | 0.20 | 0.081 | 0.019 | — | steel of invention |
| 8 | 0.044 | 0.31 | 0.89 | 0.010 | 0.010 | 0.31 | 0.14 | 0.19 | 0.093 | 0.025 | — | comparative steel |
| 9 | 0.039 | 0.29 | 0.83 | 0.012 | 0.014 | 0.27 | 0.14 | 0.20 | 0.140 | 0.027 | — | comparative steel |
| 10 | 0.045 | 0.30 | 0.89 | 0.009 | 0.010 | 0.29 | 0.15 | 0.01 | 0.052 | 0.032 | — | comparative steel |
| 11 | 0.046 | 0.33 | 0.91 | 0.014 | 0.011 | 0.33 | 0.17 | 0.05 | 0.053 | 0.027 | — | steel of invention |
| 12 | 0.056 | 0.33 | 0.87 | 0.009 | 0.009 | 0.30 | 0.14 | 0.09 | 0.050 | 0.024 | — | steel of invention |
| 13 | 0.051 | 0.32 | 0.81 | 0.011 | 0.011 | 0.31 | 0.16 | 0.13 | 0.049 | 0.033 | — | steel of invention |
| 14 | 0.043 | 0.28 | 0.87 | 0.008 | 0.014 | 0.29 | 0.14 | 0.20 | 0.048 | 0.024 | — | steel of invention |
| 15 | 0.036 | 0.36 | 0.82 | 0.011 | 0.014 | 0.27 | 0.16 | 0.25 | 0.051 | 0.035 | — | steel of invention |
| 16 | 0.043 | 0.28 | 0.87 | 0.008 | 0.014 | 0.26 | 0.14 | 0.30 | 0.051 | 0.021 | — | comparative steel |
| 17 | 0.044 | 0.28 | 0.88 | 0.010 | 0.012 | 0.28 | 0.15 | 0.11 | 0.050 | 0.023 | Sb: 0.05 | steel of invention |
| 18 | 0.001 | 0.27 | 0.85 | 0.005 | 0.010 | 0.20 | 0.01 | 0.19 | 0.047 | 0.047 | — | steel of invention |
| 19 | 0.011 | 0.01 | 0.36 | 0.021 | 0.004 | 0.18 | 0.10 | 0.22 | 0.063 | 0.022 | — | steel of invention |
| 20 | 0.087 | 0.30 | 0.67 | 0.012 | 0.006 | 0.10 | 0.05 | 0.10 | 0.040 | 0.019 | — | steel of invention |
| 21 | 0.150 | 0.27 | 0.55 | 0.009 | 0.012 | 0.15 | 0.08 | 0.21 | 0.051 | 0.016 | — | steel of invention |
| 22 | 0.040 | 0.79 | 0.80 | 0.010 | 0.011 | 0.18 | 0.10 | 0.19 | 0.050 | 0.016 | — | steel of invention |
| 23 | 0 038 | 0.15 | 0.11 | 0.014 | 0.013 | 0.20 | 0.13 | 0.20 | 0.050 | 0.009 | — | steel of invention |
| 24 | 0.044 | 0.28 | 1.04 | 0.015 | 0.013 | 0.21 | 0.12 | 0.20 | 0.052 | 0.022 | — | steel of invention |
| 25 | 0.038 | 0.29 | 1.24 | 0.012 | 0.012 | 0.22 | 0.20 | 0.20 | 0.048 | 0.020 | — | steel of invention |
| 26 | 0.050 | 0.33 | 1.50 | 0.011 | 0.011 | 0.19 | 0.09 | 0.22 | 0.048 | 0.017 | — | steel of invention |
| 27 | 0.049 | 0.32 | 1.83 | 0.016 | 0.012 | 0.19 | 0.12 | 0.23 | 0.050 | 0.018 | — | comparative steel |
| 28 | 0.040 | 0.35 | 0.77 | 0.016 | 0.005 | 0.20 | 0.11 | 0.19 | 0.052 | 0.033 | — | steel of invention |
| 29 | 0.029 | 0.29 | 0.79 | 0.015 | 0.011 | 0.63 | 0.42 | 0.19 | 0.047 | 0.032 | — | steel of invention |
| 30 | 0.022 | 0.45 | 0.66 | 0.013 | 0.014 | 1.00 | 0.50 | 0.18 | 0.049 | 0.041 | — | steel of invention |

TABLE 1-continued

| Steel No. | Chemical composition (% by mass) C | Si | Mn | P | S | Cu | Ni | Cr | Mo | Al | Balance | Class |
|---|---|---|---|---|---|---|---|---|---|---|---|---|
| 31 | 0.048 | 0.31 | 0.71 | 0.012 | 0.014 | 0.20 | 0.10 | 0.15 | 0.048 | 0.028 | Sn: 0.10 | steel of invention |
| 32 | 0.041 | 0.30 | 0.80 | 0.015 | 0.013 | 0.22 | 0.10 | 0.20 | 0.051 | 0.026 | Ti: 0.046 | steel of invention |
| 33 | 0.037 | 0.26 | 0.88 | 0.011 | 0.015 | 0.23 | 0.15 | 0.21 | 0.050 | 0.022 | Nb: 0.031 | steel of invention |
| 34 | 0.039 | 0.43 | 0.93 | 0.020 | 0.013 | 0.21 | 0.14 | 0.20 | 0.051 | 0.017 | V: 0.011 | steel of invention |
| 35 | 0.044 | 0.39 | 0.81 | 0.017 | 0.013 | 0.20 | 0.14 | 0.18 | 0.052 | 0.025 | B: 0.0008 | steel of invention |
| 36 | 0.060 | 0.33 | 0.84 | 0.018 | 0.017 | 0.25 | 0.12 | 0.20 | 0.050 | 0.023 | B: 0.0022 | steel of invention |
| 37 | 0.052 | 0.30 | 0.83 | 0.016 | 0.009 | 0.25 | 0.19 | 0.20 | 0.049 | 0.019 | Ti: 0.030, Nb: 0.015 | steel of invention |
| 38 | 0.066 | 0.27 | 0.78 | 0.014 | 0.009 | 0.23 | 0.19 | 0.22 | 0.048 | 0.018 | Ti: 0.124, B: 0.0010 | steel of invention |
| 39 | 0.040 | 0.34 | 0.82 | 0.014 | 0.011 | 0.22 | 0.16 | 0.21 | 0.053 | 0.022 | Ti: 0.086, Nb: 0.016, B: 0.0008 | steel of invention |

Underlined numeral: outside the scope of the invention

The test specimens were observed with an optical microscope for the metal structure on the L cross section, and the crystal grain size number G was calculated by the intercept method according to JIS G0551:2013, and converted to the average crystal grain diameter. Specifically, the ferrite average crystal grain diameter was obtained according to the item (X) described above. The total area ratio of cementite, pearlite, bainite, and martensite occupied in the metal structure was obtained, and designated as the proportion of the second phase (% by volume).

Test pieces cut from the test specimens were subjected to a sulfuric acid immersion test under the same condition as in the case where the plots in FIGS. 1 and 2 were obtained (shown above) and a hydrochloric acid immersion test under the same condition as in the case where the plots in FIGS. 3 and 4 were obtained (shown above). For the evaluation of the sulfuric acid dew point corrosion resistance, a specimen exhibiting a corrosion rate of 20 mg/cm$^2$/h or less in the sulfuric acid immersion test was designated as "O" (good), and the other was designated as "X" (poor). For the evaluation of the hydrochloric acid dew point corrosion resistance, a specimen exhibiting a corrosion rate of 4 mg/cm$^2$/h or less in the hydrochloric acid immersion test was designated as "O" (good), and the other was designated as "X" (poor).

The ferrite average crystal grain diameter, the proportion of the second phase, the result of the sulfuric acid immersion test, and the result of the hydrochloric acid immersion test of the test specimens are shown in Tables 2 and 3. Table 2 shows the results in the case where the finish rolling temperature in hot rolling is 920° C. and Table 3 shows the results in the case where the finish rolling temperature is 860° C.

TABLE 2

| Steel No. | Finish rolling temperature in hot rolling: 920° C. Ferrite average crystal grain diameter (μm) | Proportion of second phase (% by volume) | Sulfuric acid immersion test Corrosion rate (mg/cm$^2$/h) | Evaluation | Hydrochloric acid immersion test Corrosion rate (mg/cm$^2$/h) | Evaluation |
|---|---|---|---|---|---|---|
| 1 | 22.1 | 4 | 25.8 | x | 9.3 | x |
| 2 | 21.5 | 5 | 23.7 | x | 8.2 | x |
| 3 | 20.3 | 4 | 17.1 | ○ | 5.3 | x |
| 4 | 24.3 | 5 | 17.2 | ○ | 3.5 | ○ |
| 5 | 18.1 | 4 | 15.8 | ○ | 2.5 | ○ |
| 6 | 19.2 | 4 | 19.5 | ○ | 3.8 | ○ |
| 7 | 20.6 | 3 | 24.2 | x | 4.1 | x |

TABLE 2-continued

| Steel No. | Finish rolling temperature in hot rolling: 920° C. Ferrite average crystal grain diameter (μm) | Proportion of second phase (% by volume) | Sulfuric acid immersion test Corrosion rate (mg/cm$^2$/h) | Evaluation | Hydrochloric acid immersion test Corrosion rate (mg/cm$^2$/h) | Evaluation |
|---|---|---|---|---|---|---|
| 8 | 15.6 | 4 | 29.1 | x | 4.7 | x |
| 9 | 14.5 | 3 | 29.8 | x | 6.2 | x |
| 10 | 26.3 | 4 | 24.2 | x | 4.9 | x |
| 11 | 25.1 | 4 | 21.0 | x | 4.3 | x |
| 12 | 27.0 | 5 | 19.1 | ○ | 3.7 | ○ |
| 13 | 25.2 | 4 | 17.0 | ○ | 2.9 | ○ |
| 14 | 23.2 | 4 | 15.8 | ○ | 2.5 | ○ |
| 15 | 22.8 | 3 | 18.5 | ○ | 3.9 | ○ |
| 16 | 30.3 | 4 | 27.8 | x | 5.3 | x |
| 17 | 22.9 | 4 | 12.9 | ○ | 2.9 | ○ |
| 18 | 32.1 | 0 | 16.1 | ○ | 2.2 | ○ |
| 19 | 28.3 | 1 | 15.5 | ○ | 2.1 | ○ |
| 20 | 17.8 | 6 | 17.2 | ○ | 2.9 | ○ |
| 21 | 16.1 | 9 | 15.4 | ○ | 2.3 | ○ |
| 22 | 27.3 | 4 | 15.5 | ○ | 2.0 | ○ |
| 23 | 31.4 | 3 | 15.2 | ○ | 2.3 | ○ |
| 24 | 19.4 | 4 | 16.2 | ○ | 2.8 | ○ |
| 25 | 17.5 | 4 | 17.8 | ○ | 3.3 | ○ |
| 26 | 15.6 | 4 | 18.6 | ○ | 3.8 | ○ |
| 27 | 15.7 | 4 | 21.4 | x | 4.3 | x |
| 28 | 17.5 | 4 | 16.6 | ○ | 2.2 | ○ |
| 29 | 18.2 | 2 | 15.2 | ○ | 2.3 | ○ |
| 30 | 19.3 | 2 | 14.8 | ○ | 2.3 | ○ |
| 31 | 20.8 | 5 | 13.6 | ○ | 2.7 | ○ |
| 32 | 12.0 | 5 | 14.1 | ○ | 2.2 | ○ |
| 33 | 11.1 | 4 | 14.0 | ○ | 2.1 | ○ |
| 34 | 11.4 | 4 | 14.2 | ○ | 2.1 | ○ |
| 35 | 11.9 | 5 | 14.3 | ○ | 2.0 | ○ |
| 36 | 11.0 | 6 | 14.2 | ○ | 2.3 | ○ |
| 37 | 10.3 | 5 | 14.1 | ○ | 2.2 | ○ |
| 38 | 9.2 | 6 | 13.9 | ○ | 2.0 | ○ |
| 39 | 8.1 | 4 | 13.6 | ○ | 2.0 | ○ |

TABLE 3

| Steel No. | Finish rolling temperature in hot rolling: 860° C. Ferrite average crystal grain diameter (μm) | Proportion of second phase (% by volume) | Sulfuric acid immersion test Corrosion rate (mg/cm$^2$/h) | Evaluation | Hydrochloric acid immersion test Corrosion rate (mg/cm$^2$/h) | Evaluation |
|---|---|---|---|---|---|---|
| 1 | 9.4 | 4 | 22.3 | x | 6.8 | x |
| 2 | 11.6 | 5 | 19.2 | ○ | 4.0 | ○ |

TABLE 3-continued

| | Finish rolling temperature in hot rolling: 860° C. | | | | | |
|---|---|---|---|---|---|---|
| | Ferrite | Proportion of | Sulfuric acid immersion test | | Hydrochloric acid immersion test | |
| Steel No. | average crystal grain diameter (μm) | second phase (% by volume) | Corrosion rate (mg/cm²/h) | Evaluation | Corrosion rate (mg/cm²/h) | Evaluation |
| 3 | 9.7 | 4 | 15.1 | ○ | 3.6 | ○ |
| 4 | 8.8 | 5 | 12.8 | ○ | 2.9 | ○ |
| 5 | 10.5 | 4 | 11.9 | ○ | 2.3 | ○ |
| 6 | 11.6 | 4 | 16.5 | ○ | 3.5 | ○ |
| 7 | 10.3 | 3 | 20.0 | ○ | 3.9 | ○ |
| 8 | 12.0 | 4 | 22.9 | x | 4.3 | x |
| 9 | 11.6 | 3 | 28.0 | x | 5.1 | x |
| 10 | 10.9 | 4 | 22.7 | x | 4.4 | x |
| 11 | 10.6 | 4 | 19.6 | ○ | 3.7 | ○ |
| 12 | 9.6 | 5 | 17.2 | ○ | 3.2 | ○ |
| 13 | 9.8 | 4 | 15.1 | ○ | 2.6 | ○ |
| 14 | 9.3 | 4 | 13.0 | ○ | 2.4 | ○ |
| 15 | 8.5 | 3 | 17.7 | ○ | 3.7 | ○ |
| 16 | 10.2 | 4 | 26.8 | x | 5.0 | x |
| 17 | 11.6 | 4 | 8.7 | ○ | 2.8 | ○ |
| 18 | 11.1 | 0 | 14.3 | ○ | 2.1 | ○ |
| 19 | 10.7 | 1 | 12.9 | ○ | 2.0 | ○ |
| 20 | 9.3 | 6 | 15.0 | ○ | 2.8 | ○ |
| 21 | 9.5 | 9 | 14.3 | ○ | 2.1 | ○ |
| 22 | 9.5 | 4 | 14.1 | ○ | 1.7 | ○ |
| 23 | 11.9 | 3 | 13.5 | ○ | 2.1 | ○ |
| 24 | 10.5 | 4 | 14.0 | ○ | 2.7 | ○ |
| 25 | 9.8 | 4 | 15.2 | ○ | 3.1 | ○ |
| 26 | 10.6 | 4 | 16.5 | ○ | 3.5 | ○ |
| 27 | 11.3 | 4 | 20.2 | x | 4.2 | x |
| 28 | 9.3 | 4 | 14.4 | ○ | 2.1 | ○ |
| 29 | 8.7 | 2 | 13.9 | ○ | 2.0 | ○ |
| 30 | 10.5 | 2 | 13.3 | ○ | 1.9 | ○ |
| 31 | 11.2 | 5 | 12.0 | ○ | 2.5 | ○ |
| 32 | 8.4 | 5 | 12.0 | ○ | 2.0 | ○ |
| 33 | 7.3 | 4 | 11.9 | ○ | 1.9 | ○ |
| 34 | 8.5 | 4 | 12.4 | ○ | 2.0 | ○ |
| 35 | 9.6 | 5 | 11.8 | ○ | 1.7 | ○ |
| 36 | 7.3 | 6 | 12.3 | ○ | 2.1 | ○ |
| 37 | 7.2 | 5 | 12.0 | ○ | 2.0 | ○ |
| 38 | 6.2 | 6 | 11.7 | ○ | 1.9 | ○ |
| 39 | 5.1 | 4 | 11.2 | ○ | 1.8 | ○ |

As understood from Tables 1, 2, and 3, the hot-rolled steel plates having a chemical composition and a metal structure according to the invention exhibit excellent characteristics in both the sulfuric acid corrosion resistance and the hydrochloric acid corrosion resistance. On the other hand, the steel plates having a ferrite average crystal grain diameter exceeding 12.0 μm are inferior in acid dew point corrosion resistance.

The steel species Nos. 32 to 39 containing one or more of Ti, Nb, V, and B in the certain amount stably provide a structure state having a ferrite average crystal grain diameter of 12.0 μm or less even with a high hot roll finishing temperature (Table 2).

The metal structures obtained in Example 1 were a ferrite single phase for the steel species No. 18, ferrite and cementite for the steel species Nos. 19, 29, and 30, and ferrite and pearlite for the other steel species.

Example 2

The steel species Nos. 5 and 26 shown in Table 1 each were subjected to hot rolling at an extraction temperature of 1,250° C. a finish rolling temperature of 860° C. and a coiling temperature of 550° C. to provide hot-rolled steel plates having a thickness of 3.2 mm. Thereafter, the steel plates each were subjected to acid cleaning and cold rolling to provide cold-rolled steel plates having a thickness of 1.0 mm. The cold-rolled steel plates each were subjected to annealing in a continuous annealing and acid cleaning line under the following heating profiles A to C to provide acid-cleaned cold-rolled and annealed steel plates.

(A) The steel plate was subjected to a soaking treatment at 680° C. for 60 seconds, then cooled to 450° C. at an average cooling rate of 10° C./sec or more, and then retained in a temperature range of from 300 to 450° C. for 180 seconds.

(B) The steel plate was subjected to a soaking treatment at 860° C. for 60 seconds, then cooled to 450° C. at an average cooling rate of 10° C./sec or more, and then retained in a temperature range of from 300 to 450° C. for 180 seconds.

(C) The steel plate was subjected to a soaking treatment at 820° C. for 60 seconds, then cooled to 200° C. at an average cooling rate of 50° C./sec or more, and then retained in a temperature range of from 300 to 400° C. for 180 seconds.

The cold-rolled and annealed steel plates were subjected to a skin pass rolling at an elongation of 0.5% with an in-line mill provided between the acid cleaning device and the coiling device in the continuous annealing and acid cleaning line.

The resulting cold-rolled and annealed steel plates were observed with an optical microscope for the metal structure on the L cross section as similar to Example 1. Test pieces cut from the resulting cold-rolled and annealed steel plates were subjected to the sulfuric acid immersion test and the hydrochloric acid immersion test under the same test conditions as in Example 1, so as to evaluate the acid dew point corrosion resistance. The evaluation standard was the same as described for Example 1.

The results are shown in Table 4.

TABLE 4

| | | | Ferrite | Proportion of | Sulfuric acid immersion test | | Hydrochloric acid immersion test | |
|---|---|---|---|---|---|---|---|---|
| Steel No. | Heating profile | Metal structure | average crystal grain diameter (μm) | second phase (% by volume) | Corrosion rate (mg/cm²/h) | Evaluation | Corrosion rate (mg/cm²/h) | Evaluation |
| 5 | A | ferrite + pearlite | 10.6 | 4 | 13.8 | ○ | 2.5 | ○ |
| | B | | 13.4 | 6 | 20.4 | x | 4.1 | x |
| | C | ferrite + bainite | 11.9 | 7 | 15.3 | ○ | 2.6 | ○ |

TABLE 4-continued

| Steel No. | Heating profile | Metal structure | Ferrite average crystal grain diameter (μm) | Proportion of second phase (% by volume) | Sulfuric acid immersion test Corrosion rate (mg/cm²/h) | Sulfuric acid immersion test Evaluation | Hydrochloric acid immersion test Corrosion rate (mg/cm²/h) | Hydrochloric acid immersion test Evaluation |
|---|---|---|---|---|---|---|---|---|
| 36 | A | ferrite + | 9.7 | 6 | 15.7 | ○ | 2.3 | ○ |
| | B | pearlite | 12.2 | 10 | 20.2 | x | 3.7 | ○ |
| | C | ferrite + martensite | 11.2 | 7 | 16.1 | ○ | 2.5 | ○ |

As shown in Table 4, the cold-rolled and annealed steel plates produced with the heat profiles A and C satisfying the annealing condition of the invention have a ferrite average crystal grain diameter of 12.0 μm or less and exhibit excellent acid dew point corrosion resistance. It is understood that for the steel having a chemical composition within the range of the invention, excellent acid dew point corrosion resistance can be retained by controlling the ferrite average crystal grain diameter to 12.0 μm even though the metal structure is ferrite and bainite, or ferrite and martensite. On the other hand, with respect to the heat profile B, the maximum achieving temperature of the material is too high, thereby providing a ferrite average crystal grain diameter exceeding 12.0 μm, and thus the steel plates are poor in acid dew point corrosion resistance.

The invention claimed is:

1. A steel plate having excellent acid dew point corrosion resistance, consisting of a chemical composition of, in terms percentage by mass, from 0.001 to 0.15% of C, 0.80% or less of Si, 1.50% or less of Mn, 0.025% or less of P, 0.030% or less of S, from 0.10 to 1.00% of Cu, 0.50% or less of Ni, from 0.05 to 0.25% of Cr, 0.01 to 0.08% of Mo, 0.100% or less of Al, from 0 to 0.20% in total of Ti, Nb, and V, and from 0 to 0.010% of B, with the balance of Fe and unavoidable impurities, having a ferrite single phase structure, or a structure containing 30% by volume or less in total of one or more of cementite, pearlite, bainite, and martensite, with the balance of a ferrite phase, and ferrite crystal grains having an average crystal grain diameter of 12.0 μm or less.

2. The steel plate having excellent acid dew point corrosion resistance according to claim 1, wherein in the chemical composition, the total content of one kind or two or more kinds of Ti, Nb, and V is from 0.005 to 0.20%.

3. The steel plate having excellent acid dew point corrosion resistance according to claim 1, wherein in the chemical composition, the content of B is from 0.0005 to 0.010%.

4. A method for producing the steel plate having excellent acid dew point corrosion resistance according to claim 1 by producing a steel plate having a ferrite single phase structure, or a structure containing 30% by volume or less in total of one or more of cementite, pearlite, bainite, and martensite, with the balance of a ferrite phase, and ferrite crystal grains having an average crystal grain diameter of 12.0 μm or less, the method comprising subjecting a continuously cast slab to hot rolling under a condition of a finish rolling temperature of 900° C. or less and a coiling temperature of 650° C. or less.

5. A method for producing the steel plate having excellent acid dew point corrosion resistance according to claim 2 by producing a steel plate having a ferrite single phase structure, or a structure containing 30% by volume or less in total of one or more of cementite, pearlite, bainite, and martensite, with the balance of a ferrite phase, and ferrite crystal grains having an average crystal grain diameter of 12.0 μm or less, the method comprising subjecting a continuously cast slab to hot rolling under a condition of a finish rolling temperature of 930° C. or less and a coiling temperature of 650° C. or less.

6. A method for producing the steel plate having excellent acid dew point corrosion resistance according to claim 1 by producing a steel plate having a ferrite single phase structure, or a structure containing 30% by volume or less in total of one or more of cementite, pearlite, bainite, and martensite, with the balance of a ferrite phase, and ferrite crystal grains having an average crystal grain diameter of 12.0 μm or less, the method comprising a hot rolling step, a cold rolling step, and an annealing step, the hot rolling step being performed at a finish rolling temperature of 900° C. or less and a coiling temperature of 650° C. or less, and the annealing step being performed at a heating temperature of from 600 to 830° C.

7. A method for producing the steel plate having excellent acid dew point corrosion resistance according to claim 2 by producing a steel plate having a ferrite single phase structure, or a structure containing 30% by volume or less in total of one or more of cementite, pearlite, bainite, and martensite, with the balance of a ferrite phase, and ferrite crystal grains having an average crystal grain diameter of 12.0 μm or less, the method comprising a hot rolling step, a cold rolling step, and an annealing step, the hot rolling step being performed at a finish rolling temperature of 930° C. or less and a coiling temperature of 650° C. or less, and the annealing step being performed at a heating temperature of from 600 to 830° C.

8. An exhaust gas channel constituent member comprising the steel plate according to claim 1, the member constituting an exhaust gas channel of a combustion exhaust gas from a coal-fired thermal electric power plant or an exhaust gas from a waste combustion plant, in a portion where condensation occurs on a surface thereof through exposure to the exhaust gas.

* * * * *